United States Patent [19]

Swisher, Jr.

[11] Patent Number: 4,957,433

[45] Date of Patent: Sep. 18, 1990

[54] DRUM BAFFLE

[75] Inventor: George W. Swisher, Jr., Oklahoma City, Okla.

[73] Assignee: CMI Corporation, Oklahoma City, Okla.

[21] Appl. No.: 351,395

[22] Filed: May 15, 1989

[51] Int. Cl.[5] ..... F27B 7/14

[52] U.S. Cl. ..... 432/103; 432/118; 110/246

[58] Field of Search ..... 432/103, 108, 110, 111, 432/118; 110/246

[56] References Cited

U.S. PATENT DOCUMENTS

| | | | |
|---|---|---|---|
| 3,720,004 | 3/1973 | Okawara | 432/118 |
| 3,751,218 | 8/1973 | Cherenson | 432/118 |
| 3,798,789 | 3/1974 | Thompson | 432/118 |
| 4,172,701 | 10/1979 | Bernt | 432/103 |
| 4,307,520 | 12/1981 | Lutz | 432/118 |

*Primary Examiner*—Henry C. Yuen

*Attorney, Agent, or Firm*—Dunlap, Codding, Peterson & Lee

[57] ABSTRACT

A plurality of variable pitch baffles for diffusing hot combustion gases flowing through an asphalt drum mixer is provided. Each baffle, which is internally mounted at an intermediate location within the drum mixer, includes a plurality of opening therethrough.

6 Claims, 2 Drawing Sheets

DRUM BAFFLE

BRIEF SUMMARY OF THE INVENTION

1. Field of the Invention

The present invention relates generally to drum mixers used for producing an asphaltic composition.

2. Background of the Invention

The present invention provides an apparatus for use in a drum mixer for controlling the flow of hot combustion gases therethrough. Generally, in asphalt drum mixers, materials are heated therein by veiling said materials through a stream of hot combustion gases. However, as the amount of hot mix produced by a drum mixer is reduced below the drum's rated capacity, the density of the veiling material is also reduced. As a result of the reduced veiling density, the hot combustion gases tend to "channel" through the drum mixer along paths of least resistance.

"Channeling" reduces contact time between the veiling materials and the hot combustion gases, and thus reduces the heat transfer between the hot combustion gases and the materials within the drum. Therefore, to maintain a selected hot mix output temperature, the temperature of the combustion gases is increased. The end result is higher fuel cost at reduced product output levels. Additionally, higher combustion gas temperatures generally equate to a reduction in the operating life of the drum mixer.

The present invention eliminates channeling of the hot combustion gases through the drum during periods of reduced material flow by providing a plurality of baffles pivotally secured within the drum mixer. During the periods of reduced material flow, the baffles may be positioned substantially perpendicular to the normal flow of the combustion gases for diffusing said gases. By creating a turbulent flow of combustion gases within the drum mixer, "channeling" is reduced and the contact between the materials and the hot combustion gases is maximized. When normal material flow is resumed, the baffles are positioned parallel to the normal flow of combustion gases within the drum. The results are decreased fuel costs without decreasing the drum mixer production life.

DESCRIPTION OF THE PREFERRED EMBODIMENTS

Figure 1:
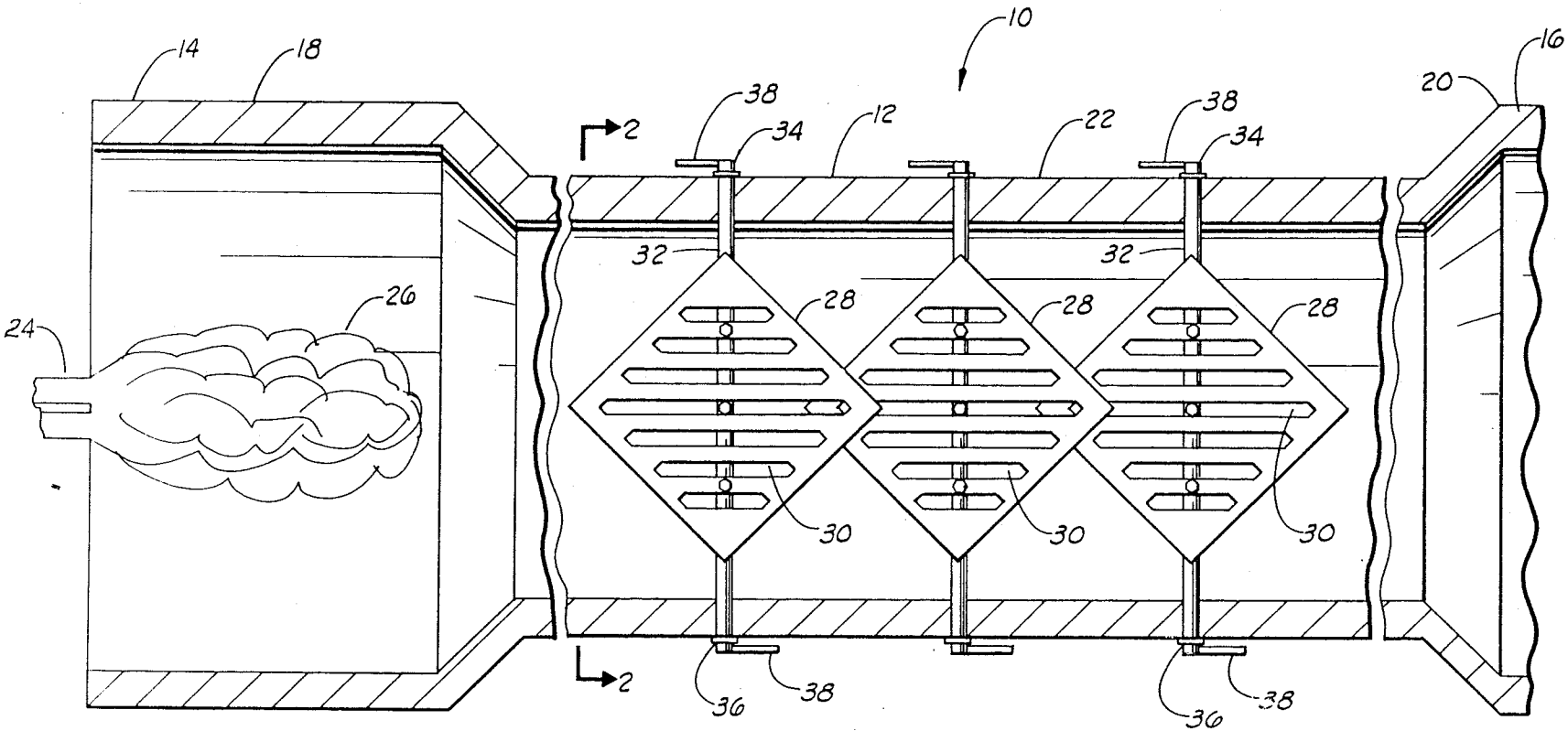
FIG. 1 is a semi-schematic, vertical cross-sectional view of a drum mixer illustrating a plurality of drum baffles constructed in accordance with the present invention.

As shown in FIG. 1, the present invention comprises a drum mixer designated generally by the reference numeral 10. The drum mixer 10 includes a drum 12 having a first end 14 and a second end 16. The drum is further characterized by having expanded portions 18 and 20, extending from the first end 14 and the second end 16 respectively, and a smaller diameter intermediate portion 22.

The drum mixer 10 further includes a burner 24, positioned at the first end 14 thereof, for producing a flame 26. The flow of hot combustion gases generated by the flame 26 is generally from the first end 14 to the second end 16 of the drum 12. It will be understood that the drum 12 may be rotated in an inclined position by conventional drive systems.

A plurality of baffles 28 are secured within the drum 12 between the first end 14 and the second end 16. Each baffle 28 is formed from a rectangular sheet of rigid, heat resistant material and includes a plurality of parallel openings 30 therein.

Each baffle 28 is secured, such as by bolting, to a shaft 32 such that a plane including the baffle 28 is perpendicular to the shaft 32. Each shaft 32 extends through mating apertures in the walls of the drum 12 and is of sufficient length that the ends 34 and 36 thereof extend for a distance beyond the drum 12. A handle 38 is secured to each end, 34 and 36, of each shaft 32.

Figure 2:
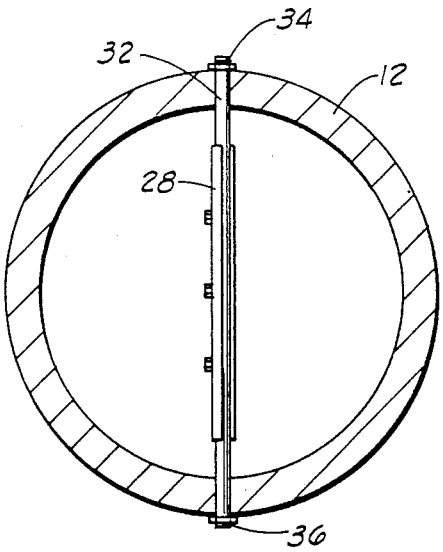
FIG. 2 is a cross-sectional view taken along lines 2—2 of FIG. 1 showing a baffle positioned parallel to the flow of matter within the drum.
Figure 3:
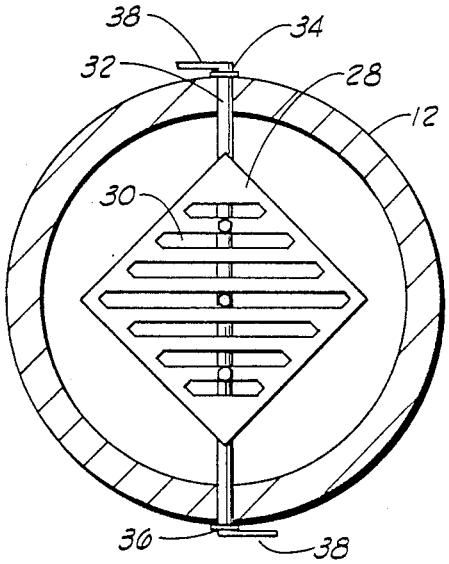
FIG. 3 is the view of FIG. 2 showing the drum baffle positioned perpendicular to the flow of matter within the drum.

Referring now to FIGS. 2 and 3, each shaft 32 is pivotally secured within the drum 12 such that the respective baffle 28 may be rotated between a first position (FIG. 2) and a second position (FIG. 3) by manipulating the respective handles 38. In the first position, the baffle 28 is parallel to the normal flow of combustion gases through the drum 12. In this position, the baffle 28 provides minimal resistance to the normal flow of the combustion gases through the drum 12.

In the second position, the baffle 28 is perpendicular to the normal flow of combustion gases within the drum 12. In this position, the baffle 28 provides maximum resistance to the normal flow of combustion gases through the drum 12. It will be understood that the baffle 28 may be positioned in any one of an infinite number of pitch angles. In this way, the normal flow of hot combustion gases through the drum mixer may be selectively diffused. It is understood that each baffle may be retained at a selected pitch by a conventional stop structure (not shown).

In the operation of an asphalt drum mixer, production output may deviate from the rated capacity of the drum. These variances may, for example, result from the particular job specifications and/or the properties or quantity of the materials utilized for producing the hot mix asphalt. As a result, the particular drum mixer may be required to operate at product output levels less than the rated capacity and at increased combustion gas temperatures.

During periods of diminished product output levels, the material veiling density within the drum is reduced. As the veiling density is reduced, the combustion gases tend to "channel" through the voids in the veiling material, thus reducing the contact time and heat transfer between the materials and said gases. In order to maintain relatively uniform product discharge temperatures, the contact time between the hot combustion gases and the materials is increased by varying the pitch of one or more baffles. Varying the baffle pitch diffuses the "channel" flow of hot gases and creastes a turbulent flow of said gases within the drum. In this way, the contact time and heat transfer between the materials and the hot combustion gases are increased.

Therefore, by selectively varying the pitch of each baffle, one drum, equipped therewith, may be tuned for optimum heat transfer between combustion gases and veiling materials during reduced product output level. Thus, one drum comparably equipped with one or more baffles would be capable of producing hot mix asphalt at varying output rates without substantially effecting fuel comsumption or plant production life.

Figure 4:
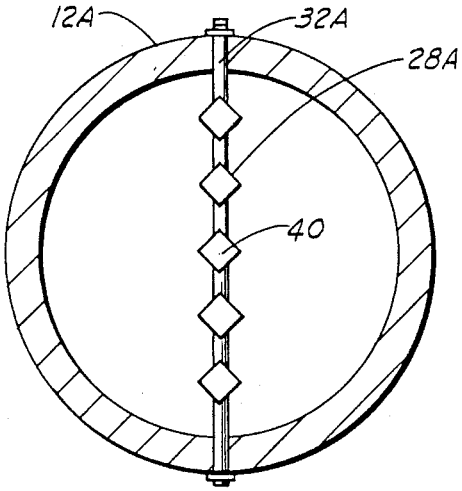
FIG. 4 is a cross-sectional view similar to FIG. 2 showing a modified drum baffle in the parallel position.
Figure 5:
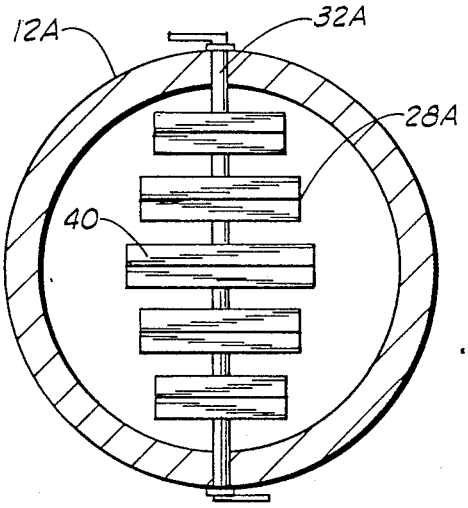
FIG. 5 is the view of FIG. 4 showing the modified drum baffle in the perpendicular position.

As shown in FIGS. 4 and 5, a modified baffle 28A is secured within the drum 12A. Each baffle 28A comprises a plurality of bars 40 secured to a shaft 32A in spaced apart relation with the axis of each bar 40 perpendicular to the axis of the shaft 32A. Each bar 40 is rectangular in cross section and is provided with an aperture (not shown) therethrough to receive the respective shaft 32A. Each shaft 32A is secured to the drum 12A in the same manner as the shafts 32 previously described and can be adjusted in the same manner as the shafts 32.

The baffle 28A operates in a similar fashion as the baffle 28 described above. In FIG. 4, the baffle 28A is illustrated in the first or parallel position. In FIG. 5 the baffle 28A is in the second or perpendicular position.

Changes may be made in the construction, operation, and arrangement of the various parts, elements, and procedures described herein without departing from the spirit and scope of the invention as defined in the following claims.

I claim:

1. In a drum used for heating solid material being veiled through the drum with hot gases of combustion flowing through the drum, the improvement comprising:

at least one baffle in the drum; and means for pivoting the baffle within the drum generally between a first position in which the baffle is parallel to the normal flow of the gases of combustion through the drum and a second position in which the baffle is perpendicular to the normal flow of the gases of combustion through the drum, wherein the means for pivoting the baffle comprising a shaft extending transversely across the drum and pivotally secured within the drum, said baffle being secured to said shaft and extending perpendicular to the axis of said shaft; and means for turning said shaft.

2. The apparatus of claim 1 wherein the drum is a rotatable drum used for asphalt production.

3. The apparatus of claim 1 characterized further to include a plurality of said shafts and baffles arranged in spaced relation along the length of the drum.

4. The apparatus of claim 1 wherein the baffle comprises a plate having a plurality of slots therethrough.

5. The apparatus of claim 1 wherein the baffle comprises a plurality of bars secured along the shaft in spaced apart relation.

6. The apparatus of claim 5 wherein each bar is rectangular in cross section.

* * * * *